US005805033A

United States Patent [19]

Liang et al.

[11] Patent Number: 5,805,033

[45] Date of Patent: Sep. 8, 1998

[54] DIELECTRIC RESONATOR LOADED CAVITY FILTER COUPLING MECHANISMS

[75] Inventors: Xiao-Peng Liang; Jennifer C. Nugent, both of Reno, Nev.

[73] Assignee: Allen Telecom Inc., Solon, Ohio

[21] Appl. No.: 606,648

[22] Filed: Feb. 26, 1996

[51] Int. Cl.[6] ..... H01P 1/20

[52] U.S. Cl. ..... 333/202; 333/212; 333/219.1; 333/230

[58] Field of Search ..... 333/208, 209, 333/212, 219.1, 230, 202, 202 DR

[56] References Cited

U.S. PATENT DOCUMENTS

| | | | |
|---|---|---|---|
| 2,432,093 | 12/1947 | Fox | 333/212 X |
| 5,220,300 | 6/1993 | Snyder | 333/212 X |
| 5,608,363 | 3/1997 | Cameron et al. | 333/202 |

FOREIGN PATENT DOCUMENTS

| | | | |
|---|---|---|---|
| 302601 | 12/1988 | Japan | 333/202 DR |
| 260901 | 10/1989 | Japan | 333/202 DR |

*Primary Examiner*—Benny Lee
*Attorney, Agent, or Firm*—Laff, Whitesel, Conte & Saret, Ltd.

[57] ABSTRACT

A dielectric resonator loaded cavity filter comprises a housing having an exterior and an interior, the housing interior including at least two adjacent cavities having dielectric resonators mounted therein. The adjacent cavities are separated by a transverse partition having a coupling window therein, the coupling window having first and second spaced opposing sidewalls. In one embodiment a coupling disk is interposed between opposing sidewalls of the transverse partition. In another embodiment a coupling strip extends from a shoulder portion of a first opposing sidewall toward a shoulder portion of a second opposing sidewall.

16 Claims, 4 Drawing Sheets

DIELECTRIC RESONATOR LOADED CAVITY FILTER COUPLING MECHANISMS

FIELD OF THE INVENTION

This invention relates generally to filters and in particular to dielectric resonator loaded cavity filters, and is more particularly directed toward coupling mechanisms providing ease of adjustment and long-term stability for dielectric resonator loaded cavity filters.

BACKGROUND OF THE INVENTION

It is well-known that $TE_{01}$ resonant modes can be coupled to one another simply by placing two dielectric resonators together in the same cavity. The closer the dielectric resonators are to one another, the stronger the coupling.

In order to control coupling between these adjacent resonators, an iris or window can be placed in between the two dielectric resonators during the filter assembly process. The degree of coupling can be adjusted by changing the dimensions of the window or iris.

In order to adjust the coupling between resonators using a window or iris, the filter must be disassembled so that window or iris size may be changed. Accordingly, a need arises for a dielectric resonator loaded cavity filter having a coupling adjustment mechanism that is easily tunable without the need for filter disassembly. This coupling adjustment mechanism should be relatively insensitive to shock, vibration, and temperature effects.

SUMMARY OF THE INVENTION

These needs and others are satisfied by the dielectric resonator loaded cavity filters of the present invention.

In one embodiment, a dielectric resonator loaded cavity filter comprises a housing having an exterior and an interior, the housing interior including at least two adjacent cavities having dielectric resonators mounted therein. The adjacent cavities are separated by a transverse partition having a coupling window therein, the coupling window having first and second spaced opposing sidewalls. A coupling adjustment screw extends from the housing exterior to the housing interior and penetrates the first spaced opposing sidewall. The coupling adjustment screw, which may be formed from a conductive material, is adjustable from the housing exterior to extend a variable distance from the first spaced opposing sidewall toward the second spaced opposing sidewall.

The dielectric resonators are preferably substantially cylindrical in shape, and may be mounted to the bottom portions of the cavities in a fixed, spaced relationship. In one form of the invention, the coupling adjustment screw lies in a plane that is substantially parallel to the cavity bottom portions, with the plane intersecting the dielectric resonators.

Preferably, the cavities are integrally formed within the housing, and are substantially rectangular in cross-section. The partition separating the adjacent cavities may also be integrally formed within the housing.

In another embodiment of the invention, a dielectric resonator loaded cavity filter comprises a housing having an exterior, an interior, and a top portion, with the housing interior including at least two adjacent cavities having dielectric resonators mounted to its bottom portions. The adjacent cavities are separated by a transverse partition having a coupling window therein, the coupling window having first and second spaced opposing sidewalls. A coupling disk is movably interposed between the first and second opposing sidewalls, the coupling disk substantially parallel to the cavity bottom portions. The coupling disk is affixed to an adjusting screw extending through the housing top portion such that the coupling disk is positioned a variable distance from the cavity bottom portions.

Preferably, the coupling disk is formed from a conductive material, and lies in a plane that is substantially parallel to the cavity bottom portions, and intersects the dielectric resonators. The first and second opposing sidewalls of the partition may diverge linearly from the cavity bottom portions toward the housing top portion.

In yet another embodiment of the invention, a dielectric resonator loaded cavity filter comprises a housing having an exterior, an interior, and a top portion, the housing interior including at least two adjacent cavities having dielectric resonators mounted to their bottom portions. The adjacent cavities are separated by a transverse partition having a coupling window therein, the coupling window having first and second spaced opposing sidewalls, each of the sidewalls including a shoulder portion defining a sidewall step. A coupling strip is removably affixed to the shoulder portion of the first sidewall and extends across the coupling window, substantially parallel to the cavity bottom portions, toward the shoulder portion of the second sidewall, the coupling strip being spaced above the shoulder portion of the second sidewall. The coupling strip is adjustable through the housing top portion to vary the coupling strip spacing above the shoulder portion of the second sidewall.

The sidewall steps preferably lie in a plane that is substantially parallel to the cavity bottom portions, and intersects the dielectric resonators. The coupling strip is preferably formed from a conductive material.

Further objects, features, and advantages of the present invention will become apparent from the following description and drawings.

DETAILED DESCRIPTION OF THE INVENTION

In accordance with the present invention, dielectric resonator loaded cavity filters are described that provide distinct advantages when compared to the prior art. The invention can best be understood with reference to the accompanying drawing FIGS.

Figure 1:
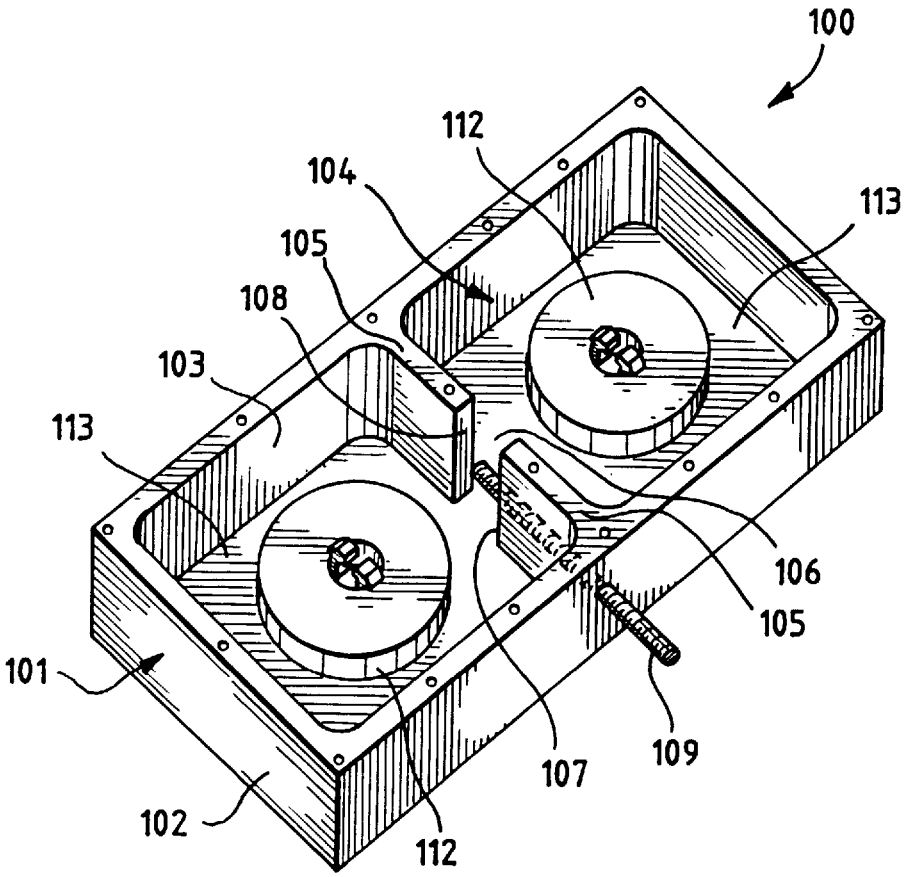
FIG. 1 is a top right perspective view of a portion of a dielectric resonator loaded cavity filter with the top cover removed.
Figure 2:
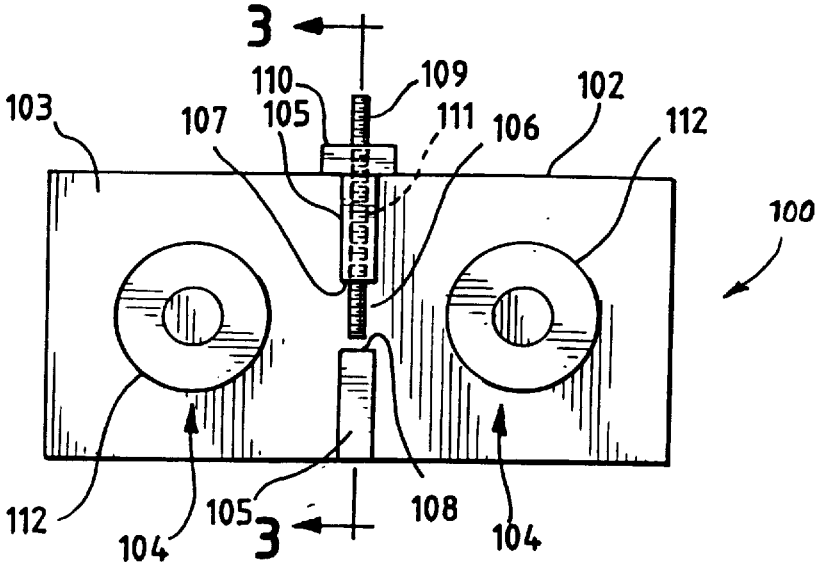
FIG. 2 is a top plan view of the filter of FIG. 1.
Figure 3:
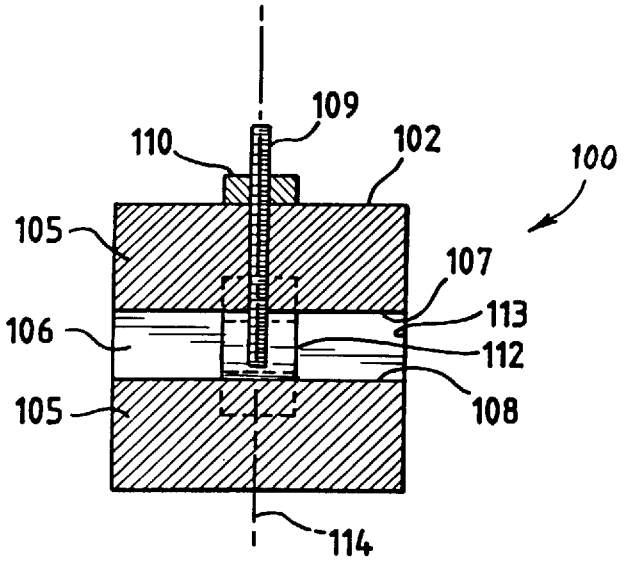
FIG. 3 is an end section view along section lines 3—3 of FIG. 2.

Referring now to FIGS. 1 through 3, a dielectric resonator loaded cavity filter 100 includes a housing 101 (see FIG. 1) having an exterior 102 and an interior 103 (see FIGS. 1 and 2). The housing 101 may be formed by casting a conductive material, such as aluminum, for example. In the alternative, the housing 101 may be molded from-a suitable non-conductive material, such as plastic. If a non-conductive material were to be used to form the housing 101, the interior portions 103 of the housing 101 would require a coating of conductive material.

The housing interior 103 includes at least two adjacent cavities 104 as shown in FIGS. 1 and 2. These cavities 104 may be formed integrally as part of a housing casting or molding operation, or may be constructed using other suitable techniques. Preferably, the cavities 104 are substantially rectangular in cross-section. The cavities 104 are separated by a transverse partition 105, that may also be integrally formed during a casting or molding operation. The transverse partition 105 has a coupling window 106 formed therein. The coupling window 106 has first and second spaced opposing sidewalls 107, 108.

A coupling adjustment screw 109, preferably formed from a conductive material, such as brass, for example, extends from the exterior 102 of the housing 101 to the housing interior 103, penetrating the first opposing sidewall 107. A nut 110 (see FIGS. 2 and 3) may be provided that can be tightened against the housing exterior 102 to prevent inadvertent rotation of the coupling adjustment screw 109.

The coupling adjustment screw 109 is adjustable from the housing exterior 102 to extend a variable distance from the first opposing sidewall 107 to the second opposing sidewall 108 of the coupling window 106. An opening 111 (see FIGS. 1 and 2) in the housing 101 that accommodates the coupling adjustment screw 109 is preferably threaded for this purpose.

Dielectric resonators 112, preferably cylindrical in shape; are mounted to bottom portions 113 (see FIGS. 1 and 3) of the cavities 104 in a fixed, spaced relationship. The coupling adjustment screw 109 lies in a plane 114 (see FIG. 3) that is substantially parallel to the bottom portions 113 of the cavities 104, and this plane 114 intersects the dielectric resonators 112. This region within the plane 114 represents the area of maximum field strength between the adjacent resonators 112, and is thus the region in which the coupling adjustment screw 109 will have maximum effect in adjusting the coupling between the $TE_{01}$ resonant modes of the adjacent resonators.

Figure 4:
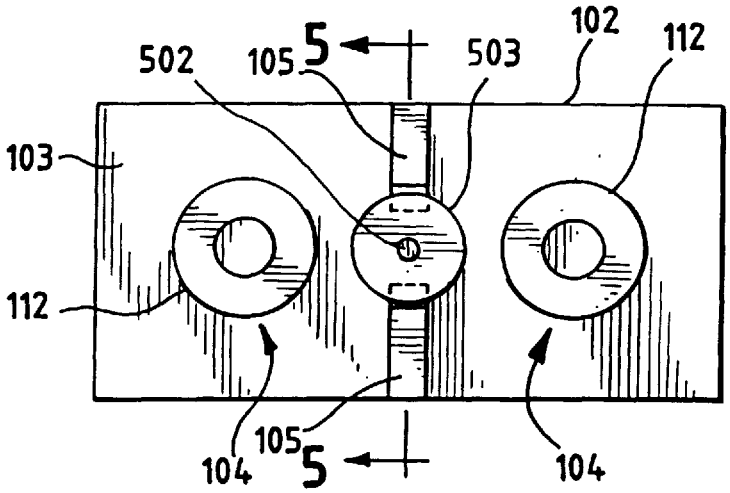
FIG. 4 is a top plan view of another embodiment of a filter in accordance with the present invention.
Figure 5:
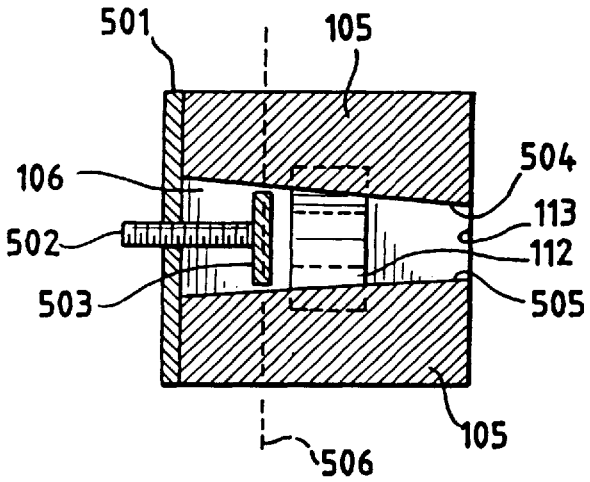
FIG. 5 is an end section view along section lines 5—5 of FIG. 4.

Turning now to FIGS. 4 and 5, another embodiment of the dielectric resonator loaded cavity filter of the present invention is illustrated. Since the general configuration of the housing 101, the housing exterior 102, the housing interior 103, the cavities 104, and the dielectric resonators 112 is identical to that illustrated in FIG. 1, details of these elements will be omitted here.

In the embodiment of FIGS. 4 and 5, the cavities 104 (see FIG. 4) are separated by a transverse partition 105, much as described previously. However, the first and second spaced opposing sidewalls 504, 505 form a V-shape, diverging linearly from the cavity bottom portions 113 toward the housing top 501 as shown in FIG. 5.

Movably interposed between the first and second opposing sidewalls 504, 505 is a coupling disk 503. The coupling disk 503 is affixed to an adjusting screw 502 that extends through the housing top-portion 501, such that the coupling disk 503 remains substantially parallel to the cavity bottom portions 113. By rotating the adjusting screw 502 from the housing exterior 102, the distance between the couplingdisk 503 and the cavity bottom portions may be varied.

The coupling disk 503, preferably formed from a conductive material, such as brass, for example, lies in a plane 506 (see FIG. 6) that is substantially parallel to the cavity bottom portions 113. To be most effective, the coupling disk should be aligned with the dielectric resonators 112. In other words, the plane 506 in which the coupling disk lies should intersect the dielectric resonators 112. The coupling disk 503 is not shown in this position in FIG. 5 for the sake of clarity of view.

Since the opposing sidewalls 504, 505 of the coupling window 106 are tapered, as the coupling disk is moved nearer to or farther from the cavity bottom portions 113, the distance between the coupling disk 503 and the opposing sidewalls 504, 505 also varies, extending the coupling adjustment range in this embodiment.

Figure 6:
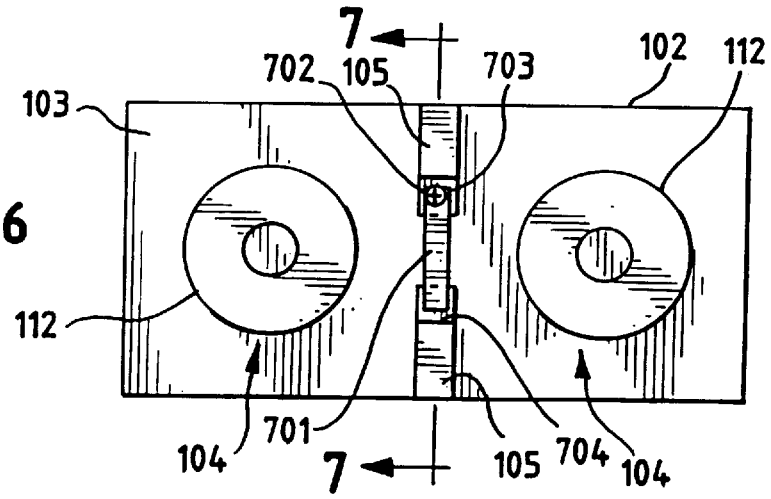
FIG. 6 is a top plan view of yet another embodiment of a filter is accordance with the present invention.
Figure 7:
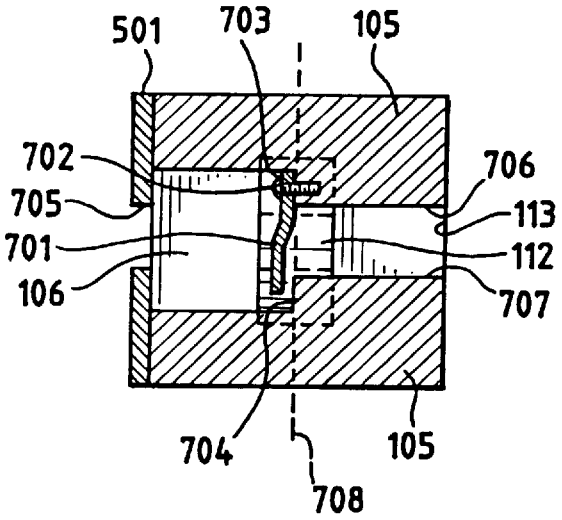
FIG. 7 is an end section view along section lines 7—7 of FIG. 6.

FIGS. 6 and 7 illustrate yet another embodiment of a dielectric resonator loaded cavity filter of the present invention. Just as in the last-described embodiment, the housing 101, the housing exterior 102, the housing interior 103, cavities 104, and dielectric resonators 112 are identical to those described with respect to FIG. 1, and will not be described again here.

In the embodiment of FIGS. 6 and 7, the adjacent cavities 104 (see FIG. 6) are separated by a transverse partition 105 having first and second spaced, opposed, sidewalls 706, 707 of the coupling window 106, where each of the sidewalls 706, 707 (see FIG. 7) includes a shoulder portion, 703, 704, respectively, defining a sidewall step. A coupling strip 701, preferably formed from a conductive material, such as brass, for example, is removably affixed to the shoulder portion 703 of the first opposing sidewall 706, preferably using a screw 702, or other suitable attachment method.

The coupling strip 701 extends across the coupling window 106, substantially parallel to the cavity bottom portions 113, toward the shoulder portion 704 of the second sidewall 707. As can be appreciated from an examination of FIG. 7, the coupling strip 701 is spaced slightly above the shoulder portion 704 of the second sidewall 707. The coupling strip 701 is adjustable through an opening 705 provided in the housing top 501. The opening 705 may be closed by a conductive cap after any coupling adjustments have been completed.

Using an appropriate tool, the coupling strip 701 may be bent slightly in order to vary the coupling strip 701 spacing above the shoulder portion 704 of the second sidewall 707. Coupling between adjacent resonators depends upon the gap corresponding to the spacing between the coupling strip 701 and the shoulder 704. Use of the coupling strip just described has the additional advantage over other coupling adjustment methods that filter spurious responses are reduced in amplitude and pushed farther away from the frequency band of interest.

The sidewall steps 703, 704 lie in a plane 708 that is substantially parallel to the cavity bottom portions 113 as shown in FIG. 7, and intersects the dielectric resonators 112.

There have been described herein dielectric resonator loaded cavity filters that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A dielectric resonator loaded cavity filter comprising:

a housing having an exterior, an interior, and a top portion;

said housing interior including at least two adjacent cavities having respective dielectric resonators mounted to bottom portions thereof;

said adjacent cavities separated by a respective transverse partition having a corresponding coupling window therein, the respective coupling window having first and second spaced opposing sidewalls which diverge linearly from said cavity bottom portions toward said housing top portion;

a respective coupling disk movably interposed between said corresponding first and second opposing sidewalls, said respective coupling disk substantially parallel to said cavity bottom portions; and wherein said respective coupling disk is affixed to a corresponding adjusting screw extending through said housing top portion such that said respective coupling disk is positioned a variable distance from said cavity bottom portions.

2. The dielectric resonator loaded cavity filter of claim 1, wherein said respective dielectric resonators are substantially cylindrical in shape.

3. The dielectric resonator loaded cavity filter of claim 2, wherein said respective dielectric resonators are mounted to said bottom portions of said cavities in a fixed, spaced relationship therefrom.

4. The dielectric resonator loaded cavity filter of claim 3, wherein said respective coupling disk lies in a plane that is substantially parallel to said cavity bottom portions, said plane intersecting said respective dielectric resonators.

5. The dielectric resonator loaded cavity filter of claim 1, wherein said cavities have an integral construction within said housing.

6. The dielectric resonator loaded cavity filter of claim 5, wherein said respective cavities are substantially rectangular in cross-section.

7. The dielectric resonator loaded cavity filter of claim 1, wherein said respective partition has an integral construction within said housing.

8. The dielectric resonator loaded cavity filter of claim 1, wherein said coupling disk is comprised of a conductive material.

9. A dielectric resonator loaded cavity filter comprising:

a housing having an exterior, an interior, and a top portion;

said housing interior including at least two adjacent cavities having respective dielectric resonators mounted to bottom portions thereof;

said adjacent cavities separated by a respective transverse partition having a corresponding coupling window therein, the respective coupling window having first and second spaced opposing sidewalls, each of said sidewalls including a respective shoulder portion defining a corresponding sidewall step;

a respective coupling strip removably affixed to the shoulder portion of said corresponding first sidewall and extending across said respective coupling window, substantially parallel to said bottom portions, toward the shoulder portion of said corresponding second sidewall, said respective coupling strip being spaced above the shoulder portion of said corresponding second sidewall; and wherein said respective coupling strip is adjustable through said housing top portion to vary the coupling strip spacing above the shoulder portion of said corresponding second sidewall.

10. The dielectric resonator loaded cavity filter of claim 9, wherein said respective dielectric resonators are substantially cylindrical in shape.

11. The dielectric resonator loaded cavity filter of claim 10, wherein said respective dielectric resonators are mounted to said bottom portions of said cavities in a fixed, spaced relationship therefrom.

12. The dielectric resonator loaded cavity filter of claim 11, wherein said respective sidewall steps lie in a plane that is substantially parallel to said cavity bottom portions, said plane intersecting said respective dielectric resonators.

13. The dielectric resonator loaded cavity filter of claim 9, wherein said cavities have an integral construction within said housing.

14. The dielectric resonator loaded cavity filter of claim 13, wherein said respective cavities are substantially rectangular in cross-section.

15. The dielectric resonator loaded cavity filter of claim 9, wherein said partition has an integral construction within said housing.

16. The dielectric resonator loaded cavity filter of claim 9, wherein said coupling strip is comprised of a conductive material.

* * * * *